US005116006A

United States Patent [19]

Ocampo

[11] Patent Number: 5,116,006

[45] Date of Patent: May 26, 1992

[54] SAFETY DETECTOR FOR RAILROAD SWITCH POINTS WITH REMOTE CONTACT MECHANISM

[76] Inventor: Salvador C. Ocampo, 4715 W. Wrightwood Ave., Chicago, Ill. 60639

[21] Appl. No.: 776,725

[22] Filed: Oct. 15, 1991

Related U.S. Application Data

[63] Continuation of Ser. No. 405,659, Sep. 11, 1989, abandoned.

[51] Int. Cl.[5] ..... B61L 5/10

[52] U.S. Cl. ..... 246/220; 246/162

[58] Field of Search ..... 246/162, 176, 220, 476; 200/239, 249, 251, 286, 341; 238/283, 382

[56] References Cited

U.S. PATENT DOCUMENTS

| | | | |
|---|---|---|---|
| 500,041 | 5/1893 | Swartz | 246/220 |
| 975,922 | 11/1910 | Adams | 246/220 X |
| 1,781,284 | 11/1930 | Karl | 246/176 |
| 4,316,578 | 2/1982 | Reynolds et al. | 238/382 X |
| 4,527,736 | 7/1985 | Ortwein | 238/382 X |
| 4,986,498 | 1/1991 | Rotter et al. | 246/220 X |

FOREIGN PATENT DOCUMENTS

| | | | |
|---|---|---|---|
| 598866 | 12/1925 | France | 246/162 |
| 629299 | 11/1927 | France | 246/220 |
| 52348 | 4/1910 | Switzerland | 246/162 |

*Primary Examiner*—Frank E. Werner
*Assistant Examiner*—Scott L. Lowe
*Attorney, Agent, or Firm*—Martin Faier

[57] ABSTRACT

A safety detector for a railroad switch point having detector mechanism which is to be secured to a stockrail at the switch point where the stockrail is intended to be in contact with a corresponding switchrail, in which the detector mechanism is adjustably secured in a housing and has a spring loaded plunger assembly normally biased in the direction of the switchrail and reciprocably secured through the stockrail in alignment with the switchrail at the switch point, electrical contacts connected to the plunger assembly for reporting contact or the lack of contact between the switchrail and the stockrail, and a contact on the switchrail at the switchpoint for reciprocating the plunger against the electrical reporting contacts when the switchrail is in physical contact with the stockrail at the switchpoint.

21 Claims, 2 Drawing Sheets

FIG. 1
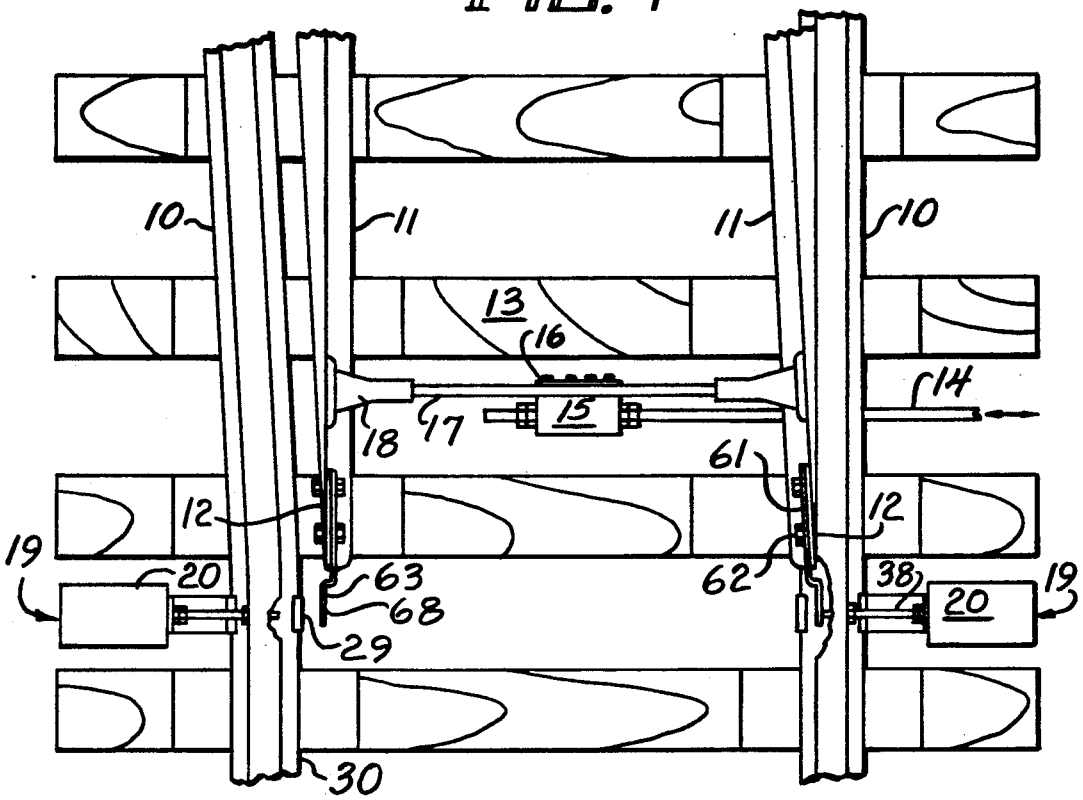
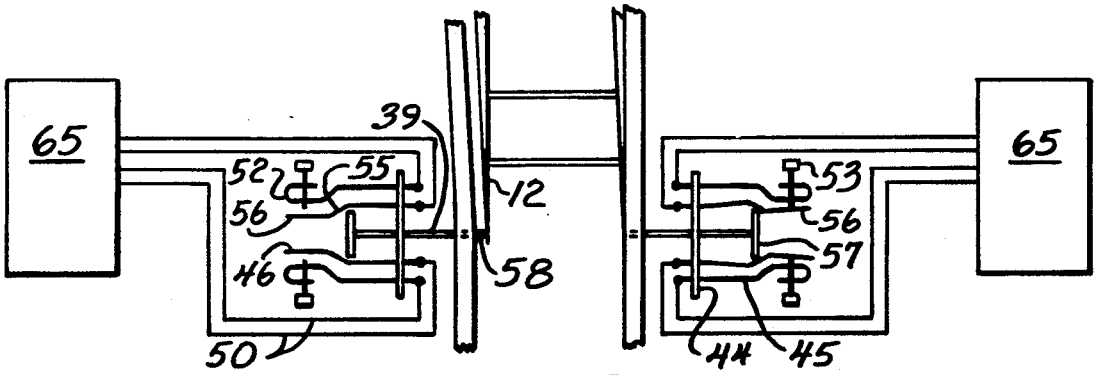
FIG. 3
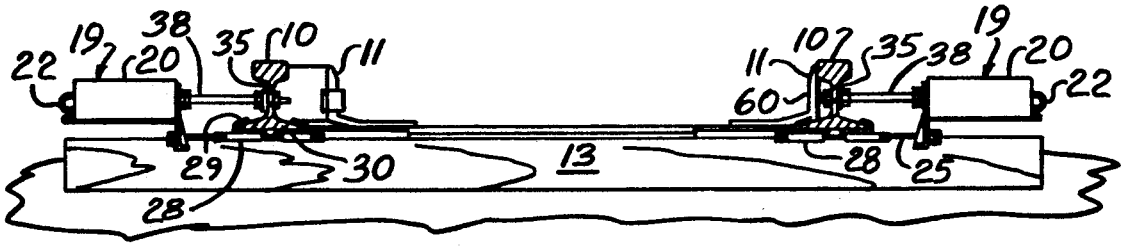
FIG. 2

SAFETY DETECTOR FOR RAILROAD SWITCH POINTS WITH REMOTE CONTACT MECHANISM

This is a continuation of application Ser. No. 07/405,659, filed Sept. 11, 1989 now abandoned.

This invention relates to a safety detector for railroad switch points, and is more particularly directed to such a device which is capable of positively indicating whether or not the point of a railroad switch track is open or closed.

BACKGROUND AND SUMMARY OF THE INVENTION

Devices intended for ascertaining whether or not a railroad switch is open are quite old and have been used in association with most switch mechanisms for many years in railroad yards, hump yards and on mainlines. Such mechanisms depend mostly upon the accuracy and capability of the switch itself to detect failures that will cause the switch point to open. Many devices are very sophisticated and electronically controlled, and such prior art devices frequently are intended to permit ascertaining whether or not the switch is closed from remote points.

However, even in the light of such sophisticated equipment, railroads continue to suffer derailments. It is believed that the cause for many of these derailments can be traced to conventional mechanisms for detecting whether a switch is open or closed. Such prior art mechanisms are usually of a type which detect an obstructed open switch point, but only if the obstruction results in mechanical pressure directed against the switch machine. If there is no obstruction, the detector mechanism may cause an erroneous reading indicating that the switch is open or closed, when in fact the opposite is true.

It is believed that such detector failures can be traced to loose or worn out movable parts and mechanical components, or poor maintenance or loose ballast conditions, or poor maintenance or loose stockrail braces, or worn out or loose throwrod adjusting nuts, or worn out or defective throw rod baskets, or broken throwrods, or worn out or broken lugs connecting the switch sectors and throwrods. In any of these events, the failure can be traced to the fact that the prior art detector is adjusted and set according to calibration of the detector and the switch point, rather than a positive relationship between the stockrail and the switchrail at the point where they are intended to come together or be separated.

In such failures, even if the conventional detector is initially properly calibrated, changes occur which make the calibration inaccurate. If the calibration is changed by some condition which is not regularly detected, sometimes by a misalignment of merely about 0.05 of an inch, such as movement of the tracks relative to one another or movement of the detector or switch components, which may result from vibrations of a locomotive or rolling stock over the track or by a change in weather conditions, a derailment may result.

The present invention is designed to offer reliability and accuracy for detecting opening and closing movements of the switch points. This invention is characterized by a mechanism securely mounted to the stockrail which positively "feels" the switchtrack in a selected position at the location when the point is selectively opened or closed, so that it positively notes the presence or absence of the switchtrack at the point when the point is closed or open, as desired. If the detector shows the switch is open or if the switch is closed at the point, that fact is made known through a signal system. Such a positive indication of the condition of the point substantially insures the safety of trains traveling over the switchtrack, and improves the detection and guarantees the anticipation of any opening and closing movement of the switch point under any circumstances. The improved mechanism embodying the invention provides accurate detection of changes in the point throwrod adjustment which cause the point to open, including failures due to wearing out of movable parts, misalignments, adverse weather conditions, and breakdown of mechanical components which allow the point to open, causing a derailment.

OBJECTS AND ADVANTAGES OF THE INVENTION

The object and advantage of this invention is to provide a novel safety detector for a railroad switch point of the character referred to.

Another object is to provide novel safety detector means for preventing derailment of railroad rolling stock entering or exiting a switchtrack, irrespective of most misalignments of the switchtrack relative to the stockrail at the switchpoint.

Another object is to provide such a safety detector which is capable of positively indicating whether or not the point of a railroad switch track is open or closed.

Another object is to provide such a safety detector which is firmly secured to a stockrail located at the switchpoint of a switch track.

Another object is to provide such a novel switch detector which extends through a stockrail in the direction of a corresponding switchtrack at the intended point where the switchtrack is to be opened or closed against the stockrail.

Another object is to provide novel adjustable heavy duty spring loaded means for a switch detector, which contacts a switchtrack at the point where it is intended to be opened or closed against a stockrail.

Another object is to provide novel adjustable heavy duty electrical contact members for a switch detector which are capable of opening or closing a circuit for reporting whether a switchpoint is open or closed.

Another object is to provide a novel adjustable bracket for a switch detector which is alignable with a movable switchtrack at its point of contact with the corresponding stockrail.

Another object is to provide a novel switch detector which may be attached to a stockrail between ties and adjusted for contact with the point where a switchrail is intended to be opened or closed against the corresponding stockrail.

Another object is to provide a pair of cooperating detectors aligned with opposed points at the precise location where the switchtrack is intended to be opened or closed against the stockrail, and which will indicate whether each point is open or closed.

Another object is to provide security enclosure means and means for making and holding predetermined adjustments set for a novel switch detector assembly.

These and other objects and advantages of the invention will become more apparent as this description proceeds, taken in conjunction with the accompanying drawings.

BRIEF DESCRIPTION OF THE DRAWINGS

In the drawings:

FIG. 1 is a top elevational view of the corresponding points of switchtrack and stockrail, together with switching members, with parts broken away, showing the novel detector means embodying the invention.

FIG. 2 is an side elevational view, partially in section, of the structure shown in FIG. 1, except omitting the switching members.

FIG. 3 is a schematic view of the electrical members embodying the present invention, showing the pair of contacts, one in open position and the other in closed position.

DESCRIPTION OF A PREFERRED EMBODIMENT

Figures 4, 5, 6:
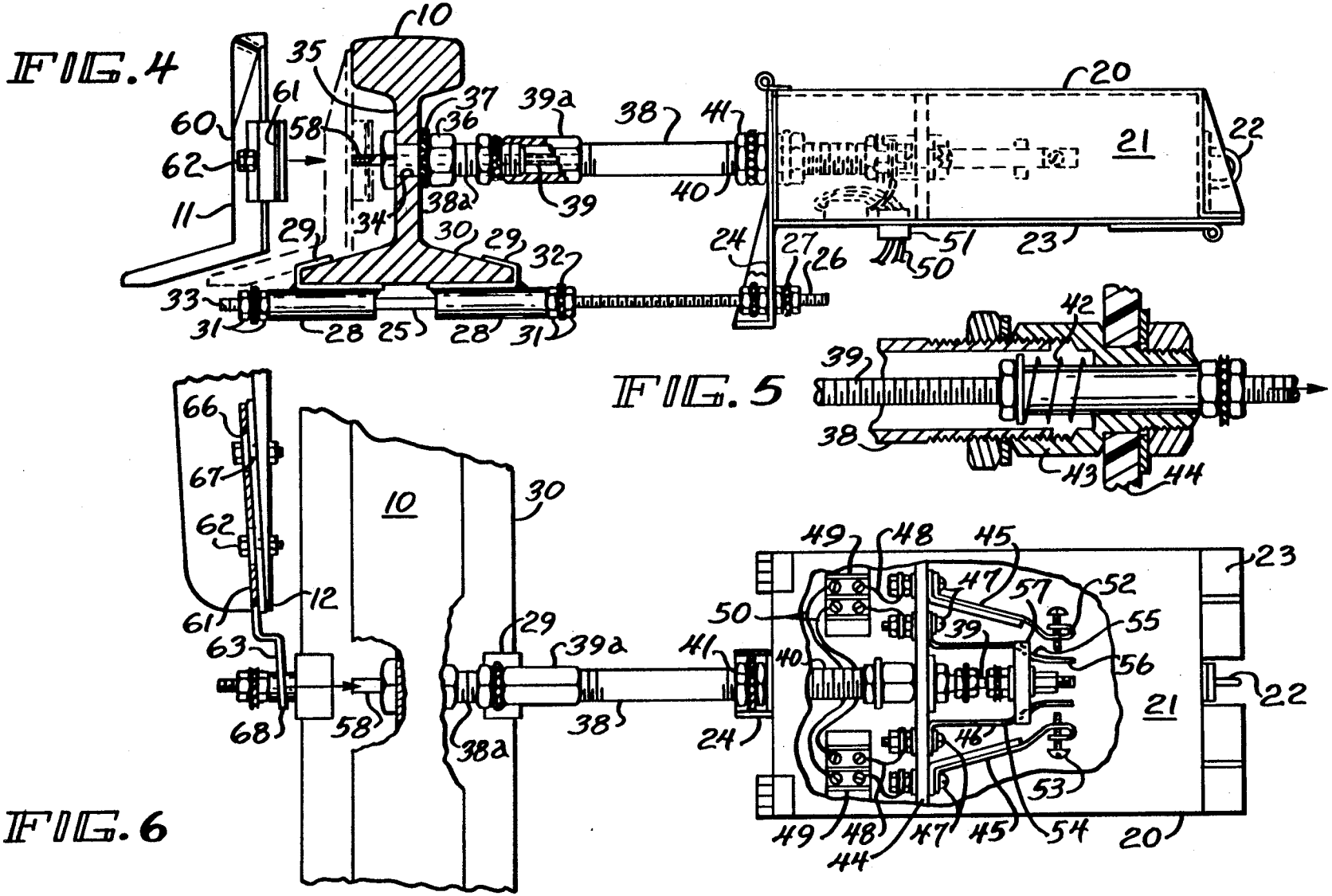
FIG. 4 is an enlarged detail view, partially in section, similar to FIG. 2, of the side elevation of an embodiment of the present invention in switch open position, with the closed position of the switchtrack shown in fantom.
FIG. 5 ia an enlarged detail view, partially in section, showing part of the spring loaded plunger assembly for the detector switch embodying the present invention.
FIG. 6 is an enlarged detail view, taken at a right angle to the view shown in FIG. 4, partially in section, of the top elevation of an embodiment of the present invention in switch open position.

With reference to the accompanying drawings, in which like numerals represent like structural members, a switch point where spaced apart stockrails or tracks 10 meet spaced apart switchrails 11 is designated as the point 12, and identifies the location where the stockrail or tracks 10 and switch rail 11 must be brought together or closed, or spaced apart or opened, to allow a train to pass thereover without fear of derailment. If the tracks are separated more than about 0.05 of an inch, a derailment may result.

These tracks are mounted laterally on a series of spaced apart ties 13. Conventionally, the opening and closing of the switchtrack 11 against the stockrail 10 at the point 12 is controlled by a switching device, which includes a switch throwrod 14 connected at one end to a switching machine (not shown) spaced apart from the tracks and at its other end connected to a switch basket 15, which connected the switchrails 11 through a bolt and plate assembly 16 to switch bars 17, the bars being connected to each of the corresponding aligned switchrails 11 by means of bracket assemblies 18 one on each switchrail.

At the point 12, arranged between the ties 13, along the corresponding aligned stockrails 10, there is secured to each of said stockrails, a detector device 19 embodying the present invention. This detector device 19 comprises a housing 20, which contains switch members hereafter described. This housing may be securely locked by means of its hinged closure cover 21 secured by a hasp assembly 22. The housing 20 has a frame 23 which is connected to bracket 24 arranged on a shaft 25, having a threaded end 26, and the housing may be adjusted on the shaft by means of a nut, washer and bolt fastener assembly 27 engaged on the threaded end of the shaft. The shaft 25 may have a pair of tubular members 28, each of which carries a angle plate 29, which may engage the heel 30 of the stockrail 10. These tubular members 28 are adjustable one relative to the other by means of nuts 31 and lock washers 32 arranged on threaded portions 33 of the shaft 25, for snug securement of the angles plates 29 on the stockrail heel 30, thus establishing the position of the switch housing 20 relative to the stockrail 10.

Secured through an aperture 34 formed in the girth 35 of the stockrail 10 by lug nuts 36 and a lock washer 37 is a shaft and plunger mechanism. This shaft and plunger mechanism comprises a pipe body 38 through which a plunger 39 extends. The pipe body 38 has threads 40 and extends into the housing 20 and may be adjustably secured thereto in a selected position by means of nut and lockwasher assembly 41. Preferably, a nipple **38*a* is secured in the stockrail aperature 34 by means of the lug nuts 36 and lock washer 37 so that only the pin 58 of the plunger 39 is exposed to weather, and the nipple is joined to and adjusted in the pipe body 38 by means of an interiorly threaded union 39*a*. The plunger 39 is spring loaded by means of a spring 42 biased against a boss 43 secured to pipe body 38 and in a plate 44 comprising part of the switch assembly within housing 20**, hereafter described.

Carried on the plate 44 are pairs of switch contacts 45 and 46, which may be anchored to the plate by means of contact screws 47, which may be connected by wires 48 to terminal blocks 49, having leads 50 which trail from the housing frame 23 through an insulated bushing 51 to signal means. The peripheral switch contacts 45 have angularly inwardly tapered legs leading to doubled ends 52 extending through which are fine adjustment contact screws 53. The interior contacts 46 have parallel straight leg portion 54 allowing the plunger 39 to freely reciprocate, and inwardly tapered leg portions 55 intended to cause contact between the ends 56 of the tapered leg portions 55 and the fine adjustment contact screws 53 when a contact plate 57 secured to the end of the plunger 39 is thrust against tapered leg portions when the plunger is reciprocated against the contacts 45 and 46 upon movement of the plunger end pin 58 in a manner to be described.

Secured to the upstanding wall 60 of the switchrail 11 at the point 12 is a bracket 61 which may be placed into a selected position by mean of adjusting nuts and bolts 62 adjustably mounting the bracket to the switchrail through slotted apertures 66 formed in the bracket and through holes 67 through the switchrail 11. The free end 63 of the bracket 61 defines a finger 68 extending from the point 12 in the direction of the stockrail 10 positioned so that this finger will feel and bear against the plunger end pin 58 reciprocally secured on the stockrail 10 and will move the plunger 39 against the spring 42 when the point 12 of the switchtrack 11 is completely closed, and thus close the circuit as described. If the point 12 is not completely closed, the plunger end pin 58, which is biased away from the tapered leg portions 55 of the contacts 46, will not allow the contact ends 56 to close against the fine adjustment contact screws 53. If the point 12 is completely closed, the plunger ends pin 58 will cause the contact plate 57 to be thrust against the tapered leg portions 55 of the contacts 46, causing the contact ends 56 to close against the fine adjustment contact screws 53.

As shown in FIG. 3, when the contact ends 56 are closed against the fine adjustment contact screws 53 (see right side of figure), a circuit is made through the wires, terminal blocks and leads, which may switch on an appropriate light in the signal means, such as on a yard signal pot 65 or other indicia to report the point 12 is closed. On the other hand, if the contact ends 56 are not closed against the fine adjustment contact screws 53 (see left side of figure), the circuit is not made which cause another light on the yard signal pot or other indica to report the point is open. These signals 65 may be located at the switch in the yard and/or they may be remote from the switchtrack in a control house for the switch yard or other railroad system.

The detector device embodying the present invention is located and arranged beneath the crown of the tracks and within dimensions extending downwardly parallel to the sides of the crown of the tracks so that the detector mechanism will not interfere with operation of a train traveling thereover. Also the detector mechanism is fully horizontally adjustable in a given vertical plane, and the detector will be actuated to show the point 12 is actually closed only when the switchtrack 11 is physically manipulated home against the stockrail 10. The detector mechanism disclosed herein may be incorporated into other railroad switchyard, mainline and hump yard systems for the purpose of indicating whether or not the point 12 is in fact open or closed.

The location for installing the safety detector embodying the present invention may be at any corresponding locations along the tapered portion of the switchtrack where it contacts the cooperating stockrail. In some cases the throw of the reciprocating plunger away from the stockrail will have to be lengthened in order to have firm contact with the switchrail, as the space at the point between the stockrail and the switchrail is sometimes tapered from the end of the switchtrack.

While a preferred embodiment of the novel detector mechanism has been shown and described in considerable detail, it is not intended that the invention should be limited to the exact construction described, as many variations and changes can be made in details of the structure without departing from the spirit of the invention. Accordingly, the invention should not be limited to the structure described except as the same may be defined by the appended claims.

I claim:

1. A safety detector for a railroad switch point where a switchrail is intended to contact a stockrail, said safety detector comprising a detector mechanism secured to said stockrail at said point, said detector mechanism having a spring loaded plunger assembly normally biased in the direction of said switchrail reciprocally secured through said stockrail in alignment with said switchrail at said point and electrical contact means connected to said plunger assembly for reporting contact or the lack of contact between said switchrail and said stockrail, and a bracket mounted on said switchrail at said point for reciprocating said plunger against said electrical reporting means when said switchrail is in physical contact with said stockrail at said point, said detector mechanism having a housing located remotely from and adjustably attached to said stockrail for containing said electrical contact means, said housing comprising a frame and a cover secured on said frame, said plunger assembly having a contact end adjacent said stockrail and an end remote therefrom in contact with said electrical contact means, and a rigid connection extending between and affixed to said contact end and said remote end, and sheating means coupled to said stockrail and said housing at a predetermined distance from said stockrail for protecting said rigid connection, said electrical contact means comprising a plate through which said plunger assembly extends, electrical contact members secured on said plate and means on said remote end for contacting said electrical contact members when said plunger is reciprocated.

2. The safety detector recited in claim 1, wherein said spring loaded plunger assembly has a contact pin extending from said stockrail in the direction of said switchrail.

3. The safety detector recited in claim 1, wherein said plunger assembly comprises a movable shaft extending through a fixed pipe body and has a spring biased against said body urging the shaft in the direction of the switchrail.

4. The safety detector recited in claim 3, wherein said movable shaft is adjustably secured in said pipe body.

5. The safety detector recited in claim 3, wherein said pipe body is adjustably secured in said stockrail.

6. The safety detector recited in claim 1, wherein said stockrail and said switchrail each have a crown for carrying railroad rolling stock thereover, and said plunger assembly is secured to said stock rail at a level below said crown.

7. The safety detector recited in claim 1, wherein said stockrail has a heel, and said detector mechanism is secured to said heel.

8. The safety detector recited in claim 1, wherein said housing has a locking hasp for secured closing of said cover on said frame.

9. The safety detector recited in claim 1, wherein said electrical contact members comprise one set of fixed contacts and another set of movable contacts which close a circuit when said plunger is reciprocated against said movable contacts.

10. The safety detector recited in claim 9, wherein said fixed contacts have fine adjustable ends for selectively adjusting the spacing between said fixed contacts and said movable contacts.

11. The safety detector recited in claim 1, wherein said bracket is adjustably secured on said switchrail.

12. The safety detector recited in claim 1, wherein said switchrail has a free end and said bracket has a finger extending from said switchrail free end adapted to contact said plunger assembly on said stockrail.

13. The safety detector recited in claim 12, wherein said finger is bent toward said stockrail a distance sufficient to permit said switchrail to close against said stockrail before said finger fully reciprocates said plunger assembly.

14. A safety detector for a railroad switch point where a switchrail is intended to contact a stockrail, said safety detector comprising a detector mechanism secured to said stockrail at said point, said detector mechanism having a spring loaded plunger assembly normally biased in the direction of said switchrail reciprocally secured through said stockrail in horizontal alignment with said switchrail at said point and electrical contact means connected to said plunger assembly for reporting contact or the lack of contact between said switchrail and said stockrail, and contact means on said switchrail at said point for reciprocating said plunger against said electrical reporting means when said switchrail is in physical contact with said stockrail at said point, said detector mechanism having a closed housing located remotely from and adjustably attached to said stockrail for containing said electrical contact means, said plunger assembly having a contact end adjacent said stockrail and an end remote therefrom in contact with said electrical contact means, said electrical contact means comprising a plate through which said plunger assembly extends, electrical contact members secured on said plate and means on said remote end for contacting said electrical contact members when said plunger is reciprocated, said detector mechanism being arranged in a plane horizontally aligned above the foot of said stockrail and having adjusting means for removably securing said mechanism in a selected position relative to the stockrail and the switchrail.

15. The safety detector recited in claim 14, wherein said contact end is reciprocated in a pipe body and only a free end of said contact end of said movable shaft adapted to contact said switchrail is exposed and extends from said pipe body.

16. The safety detector recited in claim 14, wherein said plunger assembly is adjustable relative to said electrical contact means.

17. The safety detector recited in claim 16, wherein said electric contact means has fine adjustment screw means for varying contact between said plunger and said electric contact means.

18. A safety detector for a railroad switch point where rails consisting of a switchrail and a stockrail are intended to contact one another, said safety detector comprising:

detector mechanism adjustably secured to one of said rails at said point, said detector mechanism having means directed toward said other rail to report whether there is substantial contact between said rails at said point, a housing located remotely from said detector mechanism adjustably attached to said rail to which said detector mechanism is secured, electrical contact means in said housing adapted to receive the report of said detector mechanism, and a connecting assembly connecting said detector mechanism and said contact means, said connecting assembly having a contact end adjacent said detector mechanism and an end remote therefrom in contact with said electrical contact means, said electrical contact means comprising a plate through which said connecting assembly extends, electrical contact members secured on said plate, and means on said remote end for actuating said electrical contact members when contacted by said connecting assembly.

19. The safety detector recited in claim 18, wherein said rails have a heel adjacent the surface upon which they are mounted and a clamping member for said connecting assembly is secured on the heel of said rail to which said detector mechanism is secured.

20. The safety detector recited in claim 19, wherein said clamping assembly is adjustable relative to said housing.

21. The safety detector recited in claim 18, wherein said detector mechanism, connecting assembly and electrical contact means are arranged aligned horizontally with said rails.

* * * * *